United States Patent [19]

Gartmann et al.

[11] Patent Number: 4,510,755

[45] Date of Patent: Apr. 16, 1985

[54] DEMINERALIZATION OF FEED WATER IN A STEAM SYSTEM

[75] Inventors: Russell J. Gartmann, Delran, N.J.; James S. Brown, St. Simons Island, Ga.

[73] Assignee: Transamerica DeLaval Inc., Princeton, N.Y.

[21] Appl. No.: 521,659

[22] Filed: Aug. 10, 1983

[51] Int. Cl.[3] ..... F01K 13/00

[52] U.S. Cl. ..... 60/657; 60/679

[58] Field of Search ..... 60/657, 646, 679

[56] References Cited

U.S. PATENT DOCUMENTS

| | | | |
|---|---|---|---|
| 3,930,371 | 1/1976 | Schabert | 60/679 X |
| 4,099,384 | 7/1978 | Stevens et al. | 60/657 |
| 4,237,691 | 12/1980 | Bodmer | 60/657 X |

*Primary Examiner*—Allen M. Ostrager

*Attorney, Agent, or Firm*—Hopgood, Calimafde, Kalil, Blaustein & Judlowe

[57] ABSTRACT

The invention contemplates improvement and economy in demineralization of the total flow of recirculating water in a steam-generating system which includes a condenser for recovery and recirculation of feed water. This filter demineralizer operates on a relatively small fraction of the total flow, being available as a relatively small flow of high-temperature water collected from steam-generator blow-down, from steam-separator drainage, or from other high-temperature drainage from a steam-utilization device. The purified effluent from the filter demineralizer is returned to the circulatory system for supply as pumped feed water along with other feed water pumped from condensate accumulation.

12 Claims, 4 Drawing Figures

DEMINERALIZATION OF FEED WATER IN A STEAM SYSTEM

BACKGROUND OF THE INVENTION

This invention relates to steam systems in which feed water is recirculated, as for turbine drive in a power plant or for marine propulsion, or in a generator of steam for industrial heating.

For economical operation of modern steam-generating systems, wherein condensate is the source of recycling feed water, it is important to remove contaminants, such as corrosion products and salts, and to improve feed water chemistry. A recognized technique has been to employ a demineralization filter which is operative upon the full flow of recirculating water. Such a filter and methods of its use are described in Levendusky U.S. Pat. No. 3,250,703. Filters of the character indicated are also known as condensate polishers; they rely on polishing resins (powdered ion-exchange resins) and often operate upon condensate available from the hot well of the condenser, at about 110° F. After demineralization, the water is suitably preheated and pumped for recycled entry into the steam generator. In a typical modern power plant, the preheating is to about 450° F. and the flow rate is in the order of 12,000 gallons per minute. The polishing resins are expensive and, by their temperature-sensitive nature, limit the location at which they may be used in the total system.

BRIEF STATEMENT OF THE INVENTION

It is an object of the invention to provide an improved system of demineralizing recirculating water in a steam system of the character indicated.

A specific object is to meet the above object at very much reduced equipment and operating cost and with greater efficiency than heretofore, all while significantly improving overall system chemistry.

Another specific object, for the case of nuclear power plants, is to prevent discharge from moisture separators from being returned to the hot well (of the condenser) and thus from contaminating the condensate supply, and thus also from losing thermal efficiency by loss of heat of high-temperature drain flows.

A further specific object is to reduce as much as possible, if not to entirely eliminate, the need for demineralizing the full flow of condensate-return in the feed water line.

The invention achieves these objects by performing the demineralization/filter process on only a relatively small fraction of the flow of recirculating water, the same being taken for this purpose from a part of the total cycle in which contaminants are necessarily more concentrated and at considerably elevated temperature, as compared to 110° F. at the hot-well accumulation of condensate.

In a multi-stage nuclear steam-turbine system, one or more moisture separators condition wet steam from one turbine stage for use in the next stage, and the moisture-separator drains are a source of concentrated contaminants, which have customarily been returned to the system, via the feed water heater, to the condenser hot well. For the above-indicated illustrative total-flow condition of 12,000 GPM, the fractional flow from the moisture-separator drains is in the order of 200 to 800 GPM, a relatively small fraction. In application to such a system, the invention first provides for heat exchange between the relatively hot moisture-separator flow and the relatively cool feed water flow, as forwardly pumped from the hot well of the condenser; the heat exchanger reduces the temperature of moisture-separator flow, to an intermediate level at which the demineralizing function can occur efficiently. The decontaminated effluent from the demineralizing filter may then be returned to the recirculating system at a location between the pumping of hot-well condensate, and the feed water preheater, or down stream from the preheater. The relatively short time for filter-service shutdown does not allow a deleterious accumulation of contaminants during the period of demineralizer shutdown, so that the plant cycle need not be interrupted and can be in continuous service during filter-servicing and maintenance. Once the filter is reconditioned and returned to service, it quickly extracts contaminants which had accumulated along with those which are accumulating.

DETAILED DESCRIPTION

The invention will be described in detail in conjunction with the accompanying drawings, in which.

Figure 1:
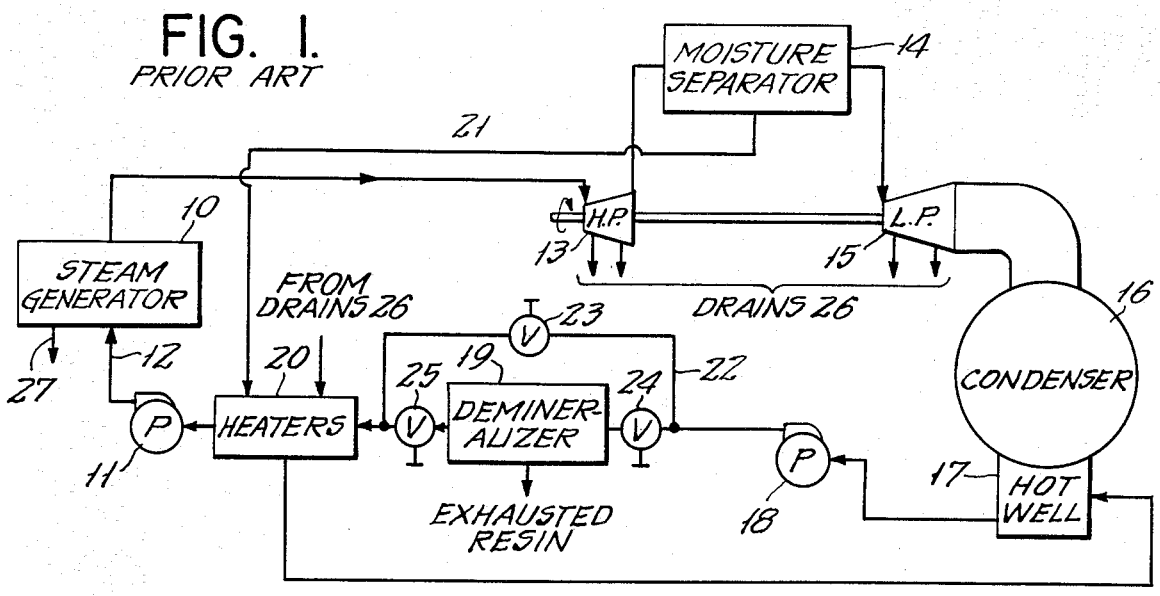
FIG. 1. PRIOR ART
FIG. 1 is a simplified schematic diagram of a typical nuclear steam-turbine power plant, representative of prior art configuration and practice.

FIG. 1, labeled "Prior Art", serves for the identification of significant components of a power plant illustrative of current practice. A steam generator 10 receives feed water from the outlet of a pump 11 in a feed water line 12. The steam produced by generator 10 is supplied directly to the inlet of a high-pressure turbine stage or cluster of stages 13. Its moist-steam exhaust is processed in moisture-separator means 14, which delivers dry steam at lesser temperature and pressure to the inlet of a low-pressure turbine stage or cluster of stages 15, shown connected to a shaft which is also coupled to the high-pressure stage(s). Exhaust flow of moist steam from the low-pressure stage(s) has ducted passage to a condenser 16 having a hot well 17 for accumulation of condensate. A pump 18 delivers a recirculating flow of feed water via a filter/demineralizer 19 to heater means 20 and thence to the feed water pump 11. Drainage from separator 14 is directed via the feed water heaters to the condenser hot well via a connection 21.

A line 22 including a shut-off valve 23 by-passes the demineralizer 19, as well as stop valves 24–25 serving the influent and effluent ends of the demineralizer, so that plant operation can proceed without interruption, during intermittent relatively short periods of demineralizer servicing; such servicing may be as described in said Brimmer et al. patent, inter alia involving removal of exhausted resin, as suggested by legend. Most plants are operated with the demineralizer on-line, except for the short intermittent periods of servicing, but in some plants the practice is to limit demineralizer use to periods of start-up and shut-down.

The invention recognizes that various sources of contaminated liquid exist in the high-temperature part of the power-plant system. These sources include: (a) the drain line 21 from moisture-separator means 14, (b) the collective drains 26 from the various turbine stages, and (c) blow-down steam at 27, available from generator 10. These sources exist by reason of normal plant utilization of all recirculated feed water. No impairment of plant efficiency occurs if one or more of these sources is used to demineralize at least the involved relatively small fraction of total-system recirculatory flow. The invention thus contemplates demineralization of such available higher-temperature water, at least as an aid to the functioning of the main feed water demineralizer 19. However, it is found that a very much smaller demineralizer unit 30 (FIG. 2) in line with one of these sources can effectively service the entire plant system and thus obviate the need for the main feed water demineralizer 19.

Figure 2:
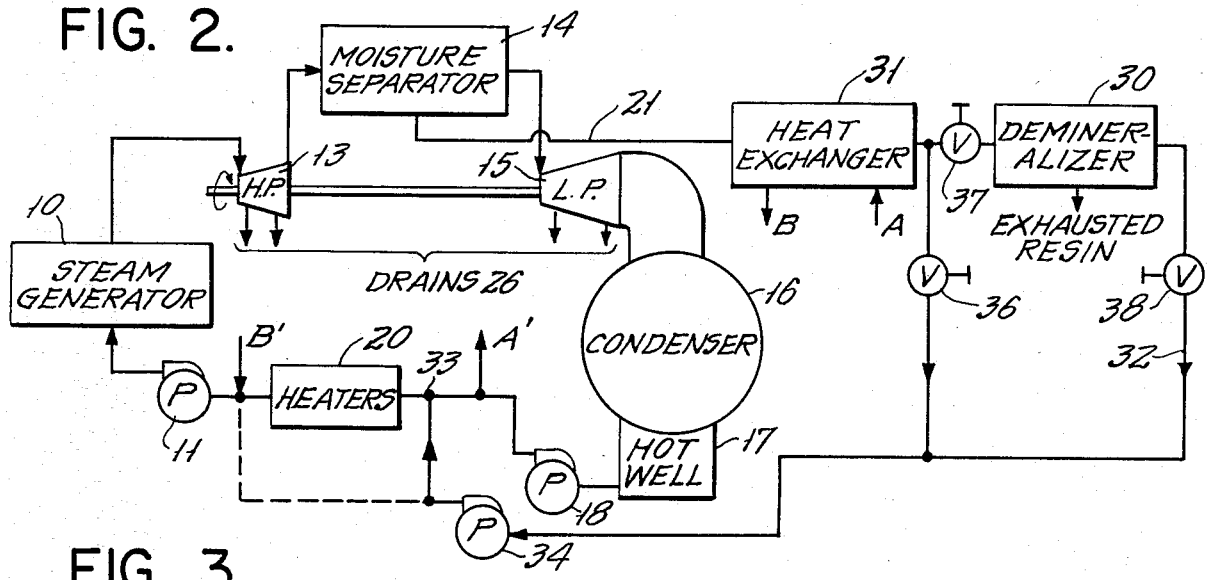
FIG. 2 is a view similar to FIG. 1, to show a preferred application of the invention to a power plant of the FIG. 1 variety.

A preferred embodiment which utilizes an available relatively small flow of higher-temperature water is shown in FIG. 2, as a modification of the system of FIG. 1 and, therefore, corresponding components are shown with the same reference numerals. In FIG. 2, the FIG. 1 demineralizer 19 in the main feed water line has been replaced by filter/demineralizer 30 in the drain line 21 from moisture-separator means 14, and a heat-exchanger 31 is in the line 21 to demineralizer 30 in order to cool the flow of moisture-separator drain water to an intermediate temperature (e.g., about 275° F.), at which temperature demineralizer (30) can be most effective. The demineralized effluent in line 32 may then be fed back to the feed water line at 33 (or between the feed water heaters and pump 11), as by using the much greater flow of condensate via pump 18, to aspirate the smaller flow of demineralized effluent; however, in the form shown, a pump 34 provides greater assurance of a desired flow rate. A by-pass line 35 with a stop valve 36 enables moisture-separator drain flow to continue for the relatively short intermittent periods of back-washing, removal of exhausted resin, replacement with fresh resin, and other servicing operations, stop valves 37–38 for this purpose being provided at inlet and outlet connections to the demineralizer 30. Again, servicing may be as described in Levendusky U.S. Pat. No. 3,250,703 and, therefore, detail of the involved hardware and procedures need not now be described.

Cooling mediums for operation of heat exchanger 31 via its inlet and outlet connections A-B may be taken from an available external source, but in FIG. 2 the main feed water flow is utilized, from pump 18. For this purpose, cooling water flow tapped at A′ will be understood to be connected to the inlet A of heat exchanger 31, and this flow, warmed by heat-exchanger action, is then returned from outlet B to a point B′ in the feed water line, between heaters 20 and pump 11.

It has already been noted that, illustratively for a modern power plant, moisture-separator drain flow (in line 21) is in the order of 200 to 800 GPM, which is but a relatively small fraction of the overall system flow (e.g., 12,000 GPM) in feed water line 12. This smaller flow means a much smaller filter/demineralizer 30 (e.g., 50 to 200 sq. ft. effective area) as compared with the main line device 19 (FIG. 1) with effective area in the order of 4500 sq. ft.* The arrangement enables moisture-separator drain flow to be pumped forward while improving overall system chemistry and thermal efficiency.

*Eg. multiple demineralizer filters, in parallel, with a total effective area in the order of 4500 sq. ft.

Figure 3:
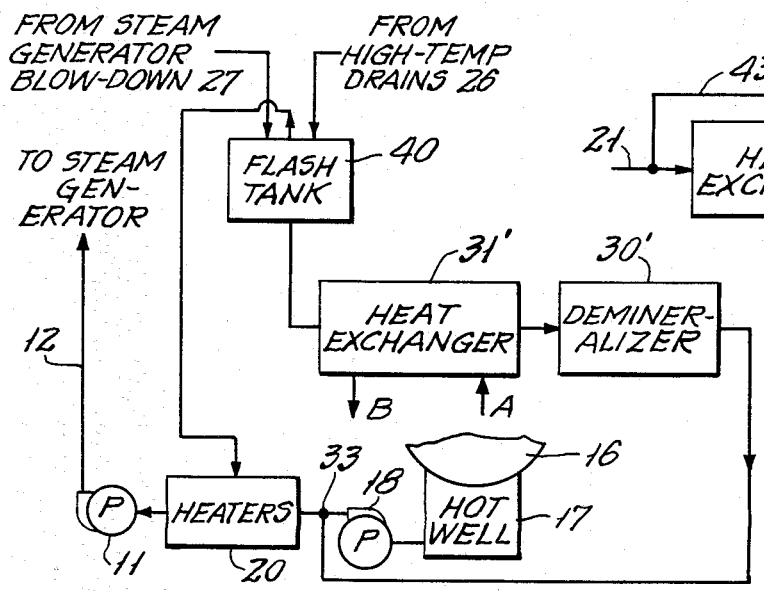
FIG. 3 is a fragmentary schematic diagram to illustrate another embodiment in a steam plant of the FIG. 1 variety.

It will be understood that current practice makes use of blow-down steam at 27 and high-temperature drains 26 as sources of heat for feed water heaters 20. FIG. 3 provides a schematic indication of such usage, and in addition FIG. 3 schematically shows a demineralizing embodiment of the invention, wherein the demineralizing function is operative on hot water drainage flow from a flash tank 40. More specifically, steam produced by generator 10 is at a high temperature in the order of 600° F., and blow-down steam in line 27 is supplied to the flash tank 40, from which vented steam is directed to heaters 20, for example to elevate feed water temperature at pump 11 to about 450° F. High temperature drain (26) flow may be supplied directly to heaters 20 or, as shown, may be supplied to the flash tank 40. Outlet flow (which outlet flow has in the past been either externally treated or discarded) of hot water from the flash tank is passed to heat-exchanger means 31′ and demineralizer means 30′ for return of demineralized water in line 41 to the forwardly pumped region of the feed water line.

Figure 4:
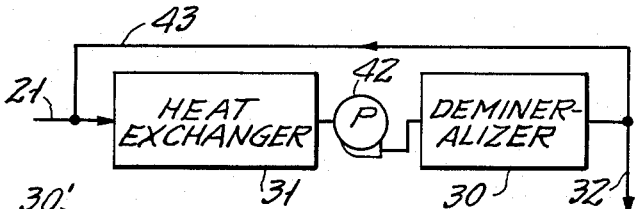
FIG. 4 is a fragmentary diagram to illustrate modification of a part of FIG. 2 or FIG. 3.

It will be seen that the described invention meets the stated objects and lends itself to different applications, of which the described arrangements are illustrative of but a few; feed water purification and drain recovery are achieved without the heat loss associated with the return of these drains to the condenser hotwell. The heat exchangers 31—31′ will be understood to be schematically shown, in that each may comprise more than one heat-exchanger unit, and the heat exchangers may be part of an auxiliary loop, with pump means 42 and a return line 43 (all as suggested in FIG. 4), whereby greater heat exchanging efficiency is achieved through regenerative heat exchanger use. It will further be understood that in addition to the handling of a large range of different temperatures, the system necessarily accommodates a large range of pressures, thus requiring regulator and other valves which, for simplicity have been omitted from present description.

While the invention has been described in detail for preferred embodiments, it will be understood that modifications may be made without departing from the scope of the invention.

What is claimed is:

1. In a feed water-recovering steam-generating system (a) wherein a moisture-separator processes the exhaust products of one stage of steam utilization for use at another stage at reduced temperature and pressure, (b) wherein one of the outputs of the moisture-separator is mechanically separated liquid at relatively high temperature and pressure, (c) wherein another of the outputs of the moisture-separator is steam used in the other stage before discharge to a condenser for condensing the utilized steam to a relatively low-temperature condensate, and (d) wherein the condensate is accumulated in a hot well prior to pumped extraction for recycled use via the feed water line to the steam generator, the improvement in which:

(1) a filter demineralizer has an inlet-line connection to the mechanically separated liquid output of said moisture separator, and (2) the outlet of said filter demineralizer is connected to the feed water line at a location downstream from where the accumulated hot-well condensate is pumped into the feed water line.

2. The improved steam-generating system of claim 1, in which a heat exchanger has a first flow passage connected in the inlet-line connection to said filter demineralizer, and in which said heat exchanger has a second flow passage in recycling flow-circulation relation with pumped condensate extracted from said condenser hot-well.

3. The improved steam-generating system of claim 2, in which said heat exchanger and filter demineralizer are connected with a pump for regenerative action.

4. The improved steam-generating system of claim 1, in which said stages are parts of steam-turbine means.

5. In a feed water-recovering multi-stage steam-turbine system including a steam generator connected to a feed water line and operating upon the total flow of feed water, and (a) wherein a relatively small fraction of the total flow is available as mechanically separated liquid at relatively high temperature and pressure, and (b) wherein the major fraction of the total flow is steam utilized in the turbine stages and thereafter condensed and accumulated for pumped extraction for recycled use, the improvement in which:

(1) a filter demineralizer has an inlet-line connection fed by the mechanically separated liquid flow, and (2) the outlet of said filter demineralizer is connected to the feed water line at a location downstream from where the accumulated hot-well condensate is pumped into the feed water line.

6. The improved system of claim 5, in which a heat exchanger is connected in the inlet-line connection to said filter demineralizer, and means for circulating coolant through said heat exchanger.

7. The improved system of claim 6, in which said coolant-circulating means includes a heat-exchanger inlet connection to the feed water line at a location downstream from the location of pumping hot-well accumulated condensate into the feed water line.

8. The improved system of claim 5, in which a heater is included in the feed water line and in which the steam generator has a blow-down outlet, means including a flash tank connected to receive blow-down steam from said outlet said flash tank being the means of providing the mechanically separated liquid flow via an outlet connection to said filter demineralizer, said tank having a flash-steam outlet connection to said heater.

9. The improved system of claim 5, in which the mechanically separated liquid flow is via hot-water drain-collection means associated with stages of the turbine.

10. The improved system of claim 5, in which moisture-separator means interconnects successive turbine stages, said moisture-separator means having an outlet drain flow which is the means of providing the mechanically separated flow to said filter demineralizer.

11. In a feed water-recovering steam-generating system comprising a steam generator connected to a feed water line and operating upon the total flow of feed water, steam-utilization means connected to said generator, a condenser connected to said utilization means to recover feed water by condensing exhaust products of said utilization device, and feed water-recirculating means including a forwardly-pumped feed water-line connection to said condenser, said system having means collecting a relatively small fraction of the total flow as mechanically separated liquid upstream from said condenser and at relatively high temperature and pressure, the improvement in which:

(1) a filter demineralizer has an inlet-line connection fed by the mechanically separated liquid flow, and (2) the outlet of said filter demineralizer is connected to the feed water line at a location downstream of the water-recirculation means.

12. The improved steam-generating system of claim 1, in which said filter demineralizer is the only such device in the total steam-generating system.

* * * * *